US010087932B2

(12) United States Patent
Huang et al.

(10) Patent No.: US 10,087,932 B2
(45) Date of Patent: Oct. 2, 2018

(54) G-ROTOR PUMP ASSEMBLY

(71) Applicant: AMERICAN AXLE & MANUFACTURING, INC., Detroit, MI (US)

(72) Inventors: Zugang Huang, Troy, MI (US); Charles G. Stuart, Rochester Hills, MI (US)

(73) Assignee: American Axle & Manufacturing, Inc., Detroit, MI (US)

( * ) Notice: Subject to any disclaimer, the term of this patent is extended or adjusted under 35 U.S.C. 154(b) by 250 days.

(21) Appl. No.: 14/547,970

(22) Filed: Nov. 19, 2014

(65) Prior Publication Data

US 2016/0138587 A1 May 19, 2016

(51) Int. Cl.
*F04C 2/10* (2006.01)
*F04C 15/00* (2006.01)

(52) U.S. Cl.
CPC ..... *F04C 15/008* (2013.01); *F04C 2/102* (2013.01); *F04C 2240/30* (2013.01); *F04C 2240/40* (2013.01); *F04C 2240/808* (2013.01)

(58) Field of Classification Search
CPC .. F04C 2/102; F04C 15/008; F04C 2240/808; F04C 2/10; F04C 2240/30; F04C 2240/40; F04C 2240/403; F04C 2240/80; F04C 2240/811; F04C 2240/51; F04C 2240/50; F04D 13/0686
See application file for complete search history.

(56) References Cited

U.S. PATENT DOCUMENTS 5,939,807 A * 8/1999 Patyk ..... H02K 5/161 310/64
2001/0033800 A1* 10/2001 Deai ..... F04D 13/064 417/370
2007/0253855 A1* 11/2007 Tsubono ..... F04C 2/084 418/61.3
2010/0008797 A1* 1/2010 Yukitake ..... F04C 2/102 417/310
2011/0033321 A1* 2/2011 Mikkelsen ..... H02K 5/1285 417/410.1
2013/0183175 A1* 7/2013 Irie ..... F04C 2/102 417/410.4

* cited by examiner

*Primary Examiner* — Dominick L Plakkoottam
*Assistant Examiner* — Philip Stimpert
(74) *Attorney, Agent, or Firm* — Harness, Dickey & Pierce, P.L.C.

(57) ABSTRACT

A G-rotor pump assembly is disclosed. The assembly makes use of a housing having a pump/motor housing portion and a laterally projecting housing portion. An electric motor is disposed within the pump/motor housing portion. A controller has a circuit board with a portion which is positioned within the pump/motor housing portion so as to be generally axially aligned with the electric motor and in proximity to the electric motor. A lower cover is configured to engage with the housing to encapsulate the controller and the electric motor within the housing.

8 Claims, 3 Drawing Sheets

G-ROTOR PUMP ASSEMBLY

FIELD

The present disclosure relates to pumps, and more particularly to G-rotor pumps often used in motor vehicle applications.

BACKGROUND

The statements in this section merely provide background information related to the present disclosure and may not constitute prior art.

Electric motor driven pumps, and particularly Gerotor type pumps (hereinafter "G-rotor" pumps), are often used in a wide variety of applications, and particularly in connection with motor vehicles. G-rotor pumps in particular are often used as fuel pumps, oil pumps, with hydraulic motors and with power steering units, just to name a few motor vehicle-related applications.

Typically the G-rotor subsystem is driven by a motor, which is typically an electric motor, but sometimes is driven from a driveshaft or other form of output shaft. When an electric motor is used as the drive implement the motor is often controlled by an electronic controller located on a separate circuit board or in a separate module remote from the motor. The separate circuit board or module is typically coupled to the electric motor by an electrical wiring harness, ribbon cable or similar electrical cabling. In this manner the electronic controller can control operation of the electric motor, and thus operation of the G-rotor pump.

The above described configuration of an electric motor and G-rotor pump, which are controlled by a remotely located controller, can present challenges when it comes to dealing with electromagnetic interference ("EMI"). The cabling that couples the remotely located electronic controller to the electric motor can sometimes act as an antenna to pick up EMI, which can negatively interfere with the intended operation of the electric motor and/or possibly operation of the electronic controller. With the large number of electronic devices now being used on modern day motor vehicles, many of which can potentially emit EMI, this has become a growing challenge for vehicle designers. Furthermore, it is often not possible to route the electrical cabling between the G-rotor motor and the controller in such a way as to guarantee that EMI will not be an issue.

Still further, there is a growing need for a G-rotor pump assembly that is even more compact than presently available G-rotor pump systems that require connection to a remote controller.

SUMMARY

In one aspect the present disclosure relates to a G-rotor pump assembly. The G-rotor pump assembly may comprise a housing having a pump/motor housing portion and a laterally projecting housing portion. An electric motor may be disposed within the pump/motor housing portion. A controller may have a circuit board with a portion which is positioned within the pump/motor housing portion so as to be generally axially aligned with the electric motor and in proximity to the electric motor. A lower cover may be included which is configured to engage with the housing to encapsulate the controller and the electric motor within the housing.

In another aspect the present disclosure may comprise a G-rotor pump assembly which includes a housing, a lower cover, an electric motor and a controller. The housing may have a pump/motor housing portion and a laterally projecting housing portion. The lower cover may be securable to the housing. The electric motor may be disposed within the pump/motor housing portion. The controller may have a circuit board with a first portion positioned within the pump/motor housing portion so as to be generally axially aligned with the electric motor and in proximity to the electric motor. The circuit board may include a second portion positioned within the laterally projecting portion, with the first portion further being sandwiched between the electric motor and the lower cover, and the electric motor and the controller being encapsulated within the housing and the lower cover.

In still another aspect the present disclosure relates to a G-rotor pump assembly comprising a housing, a lower cover, an electric motor and a controller. The housing may have a pump/motor housing portion and a laterally projecting housing portion. The lower cover may be securable to the housing. The electric motor may have a stator, an armature and a motor shaft disposed within the pump/motor housing portion. The controller may have a circuit board with a first portion positioned within the pump/motor housing portion so as to be generally axially aligned with the electric motor and in proximity to the electric motor, and a second portion positioned within the laterally projecting housing portion. The first portion may include an opening for enabling a portion of the motor shaft to pass there through, with the first portion further being sandwiched between the electric motor and the lower cover. The electric motor and the controller may be encapsulated within the housing and the lower cover. A lower motor support member may be positioned within the lower cover for assisting in supporting the electric motor.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
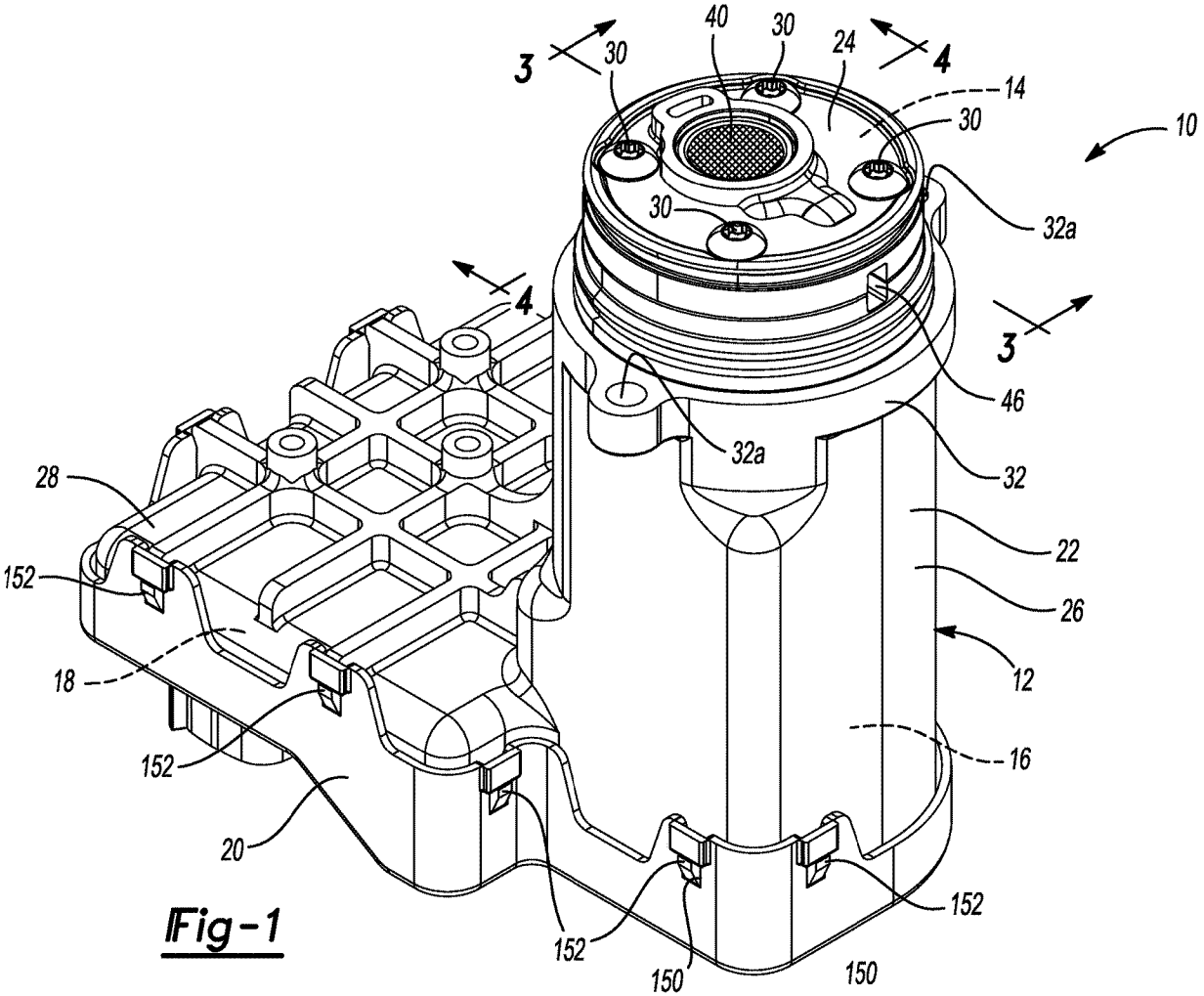
FIG. 1 is a perspective view of one embodiment of a G-rotor pump assembly in accordance with the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1 a G-rotor pump assembly constructed in accordance with the teachings of the present disclosure is generally indicated by reference numeral 10. The G-rotor pump assembly 10 may include a housing assembly 12, a gerotor pump 14, an electric motor 16, a controller 18 and a housing cover 20.

The housing assembly 12 can have a housing 22 and a cover 24. The housing 22 can be unitarily formed of a suitable material, such as die-cast aluminum, and can define a pump/motor housing portion 26 and a laterally projecting portion 28 for housing the controller 18. The cover 24 may be secured to the pump/motor housing portion 26 by a plurality of threaded fasteners 30. The pump/motor housing portion 26 may define a mounting flange 32 having mounting holes 32*a* that permit the mounting of the housing assembly 12 to another structure via a set of threaded fasteners (not shown).

Figure 2:
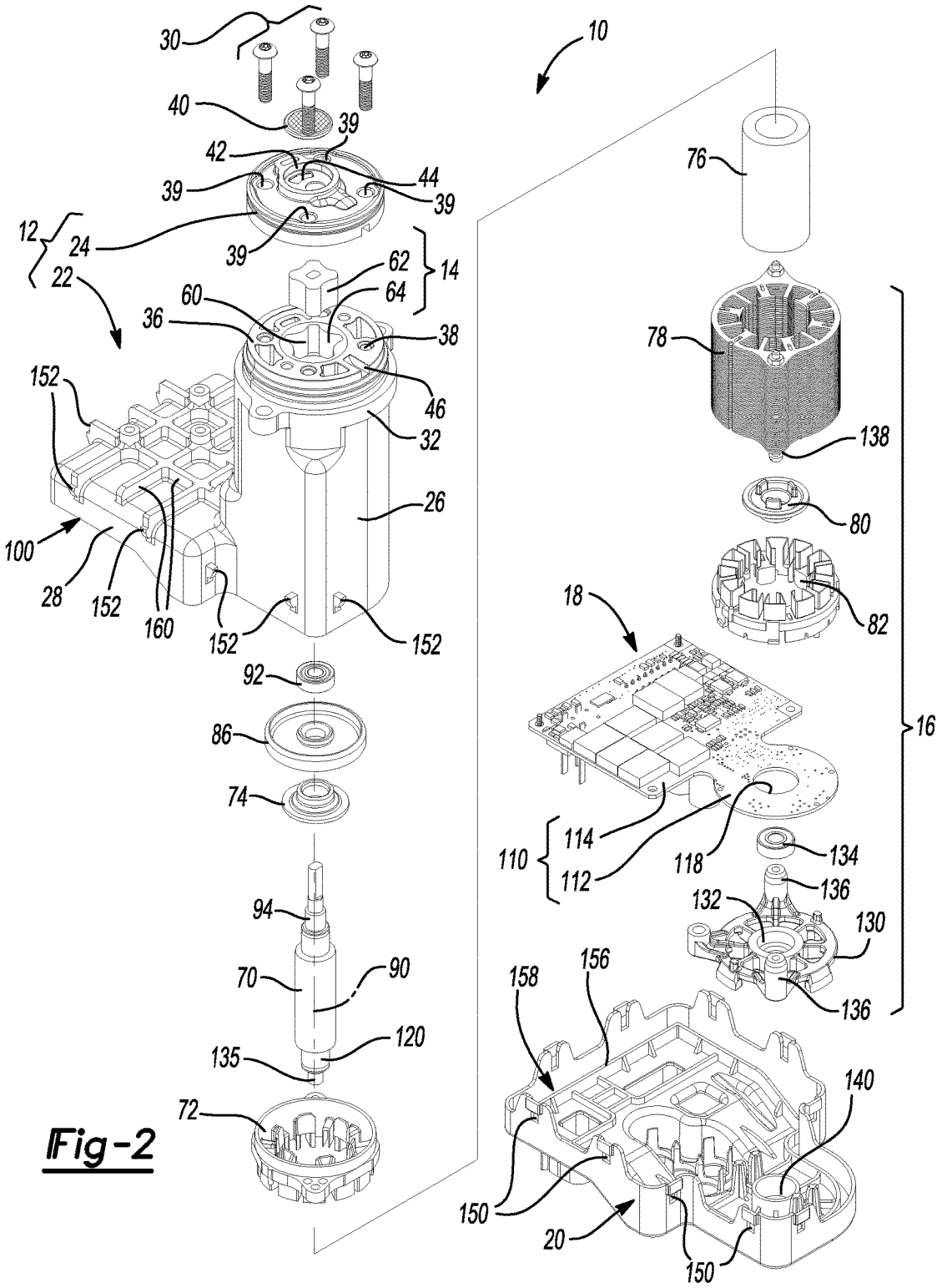
FIG. 2 is an exploded perspective view of the G-rotor pump assembly of FIG. 1.
Figure 3:
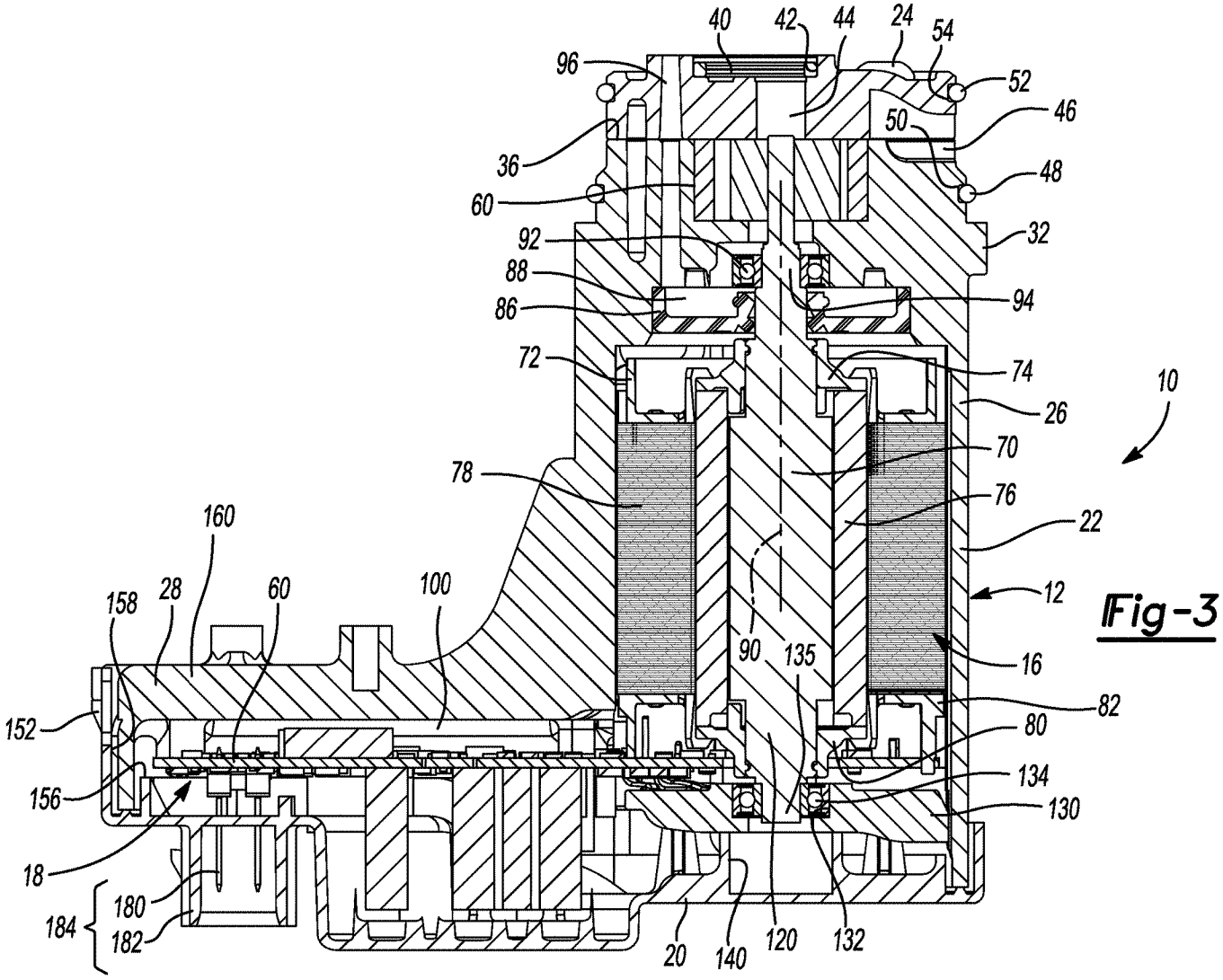
FIG. 3 is a side cross sectional view of the assembled G-rotor pump assembly of FIG. 1 taken generally along section line 3-3 in FIG. 1.

Referring to FIGS. 2 and 3, various internal component parts of the G-rotor pump assembly 10 can be seen in detail. The cover 24 is secured to an axial end face 36 of the pump/motor housing portion 26 by the plurality of threaded fasteners 30, which extend through corresponding holes 39 in the cover 24 and into threaded blind holes 38 in the axial end face 36 of the housing 22. A filter element 40, such as a wire mesh filter screen, may be positioned in a recess 42 in the cover 24 and can be employed to filter fluid entering an intake 44 in the gerotor pump 14. The pump/motor housing portion 26 can further define a fluid outlet 46 through which pressurized fluid exiting the gerotor pump 14 can flow. In the particular example provided, the fluid outlet 46 is formed on a cylindrical portion of the housing assembly 12 between a first O-ring seal 48, which is mounted in a seal groove 50 formed on the pump/motor housing portion 26 of the housing 22, and a second O-ring seal 52 that is mounted in a seal groove 54 formed on the cover 24.

The pump/motor housing portion 26 of the housing assembly 12 forms a generally hollow cylindrical cavity 60 into which the components of the gerotor pump 14 are housed. The gerotor pump 14 can comprise a conventional gerotor pump having an inner rotor 62 and an outer rotor 64. The pump/motor housing portion 26 is configured to house the electric motor 16 and the gerotor pump 14 therein.

The electric motor 16 can be comprised of a motor shaft 70, first cap 72, a first rotor cap 74, an armature 76, a stator 78, a second rotor cap 80 and a second cap 82. The inner rotor 62 of the gerotor pump 14 can be coupled to the motor shaft 70 for common rotation. A seal 86 may be received in a cavity 88 of the pump/motor housing portion 26 and disposed axially along a rotational axis 90 of the motor shaft 70 between the stator 78 and the gerotor pump 14. A bearing 92 can be mounted to the pump/motor housing 22 and can rotatably support a first end 94 of the motor shaft 70. The seal 86 can be sealingly engaged to the pump/motor housing portion 26 and to the motor shaft 70 and can prevent fluid that leaks out of the gerotor pump 14 from passing beyond the cavity 88 in the pump/motor housing portion 26 that houses the electric motor 16. If desired, fluid leaking from the gerotor pump 14 can be employed to lubricate the bearing 92 and/or the portion of the seal 86 that contacts the motor shaft 70. Optionally, the housing assembly 12 can include a fluid path 96 that permits fluid leaking from the gerotor pump 14 to be returned to a sump or reservoir (not shown) where it would be available to be input to the gerotor pump 14 via the intake 44 of the gerotor pump 14. It will be appreciated that the motor shaft 70 can be press fit or otherwise secured to the armature 76 so as to be driven rotationally in accordance with rotation of the armature 76 while the electric motor 16 is powered on. The first and second rotor caps 74 and 80 help to maintain the motor shaft 70 coaxially centered within the stator 78.

An important feature of the G-rotor pump assembly 10 is the incorporation of the controller 18, which is housed within a controller cavity 100 that is defined by the laterally projecting portion 28 of the housing 22. The controller 18 is configured to communicate with a vehicle network or data bus, such as a CAN, LIN or VAN, to receive operating commands for operating the G-rotor pump assembly 10 and/or to communicate data (e.g., fluid pressure) relevant to the operation of the G-rotor pump assembly 10. The controller 18 includes a circuit board 110 having a first portion 112, which has a generally annular shape in the particular example provided, and a second portion 114 that has a generally rectangular shape in the particular example provided.

The first portion 112 can be housed in the pump/motor housing portion 26 and can include an opening 118 through which a portion 120 of the motor shaft 70 may pass when the G-rotor pump assembly 10 is fully assembled. The first portion 112 can reside generally axially in-line with the electric motor 16 and can be electrically coupled to the electric motor 16 using wire traces on the circuit board 110 and optionally short lengths of electrical wiring (not shown), generally 0.125 inch-0.25 inch or less in length. Configuration in this manner can significantly reduce or eliminate the EMI that could be experienced with electronic controller components that are located remotely from the electric motor of a conventional G-rotor pump, and which require substantially longer lengths of electrical cabling to enable communication between the controller and the electric motor of the G-rotor pump. The second portion 114 of the circuit board 110 can be housed within the laterally projecting portion 28 of the housing assembly 12. Advantageously, this enables the controller 18, the electric motor 16 and the gerotor pump 14 to form a single, unitary, relatively compact assembly. Configuring these subcomponents in an integrated manner in a single housing also can mean a space savings over previously implemented G-rotor pump assemblies which make use a remotely located controller.

The G-rotor pump assembly 10 can further include a motor support member 130 having a circular recess 132. A bearing 134 may be positioned in the recess 132 for engaging a second end 135 of the motor shaft 70. The lower support member 130 also includes a pair of bosses 136 which can seat against a flange 138 on the stator 78. The lower support member 130 can rest on a boss 140 formed on the housing cover 20. The housing cover 20 can be shaped to engage with housing assembly 12 to completely enclose the controller 18 and the electric motor 16 within the housing assembly 12. Bearings 92 and 134 further help to support the motor shaft 70 for rotation and to maintain the armature 76 and its motor shaft 70 coaxially centered within the stator 78. When fully assembled, the first portion 112 of the circuit board 110 is sandwiched between the electric motor 16 and the combination of the lower motor support member 130 and housing cover 20. The first portion 112 can be configured with sensors, e.g., Hall-effect sensors, that can be employed to sense a portion of the armature 76 and generate associated signals that the controller 18 can employ to determine the rotational position of the armature 76 relative to the stator 78 (e.g., for controlling commutation).

The housing cover 20 can include a plurality of generally square shaped openings 150, while the housing assembly 12 includes a plurality of tabs 152. The tabs 152 and openings 150 are arranged so that the housing assembly 12 and the housing cover 20 can be pushed together so that the tabs 152 will engage in the openings 150 to secure the housing assembly 12 to housing cover 20 with a snap-fit like engagement there between. A generally continuous ledge 156 is formed within a portion of the perimeter of the housing cover 20 to form a channel 158 between an inside surface of the housing cover 20 and the ledge 156. An edge of the housing assembly 12 may rest in the channel 158 when the housing cover 20 is secured to the housing assembly 12.

The unitary construction of the housing assembly 12 has several advantages over an assembly that employs discrete gerotor, motor and controller components. One advantage relates to improved positioning of the motor shaft 70 and the gerotor pump (i.e., gerotor pump 14). Another advantage relates to improved heat rejection capabilities. In this regard, it will be appreciated that heat generated during operation of the G-rotor pump assembly 10 can be rejected to the housing assembly 12. As the housing assembly 12 is formed of aluminum in the particular example provided, it can function as a relatively large heat sink. Moreover, heat sink features 160, such as a plurality of raised ribs, can be formed into desired portions of the housing assembly 12, such as on a side of the laterally projecting portion 28 that is opposite the housing cover 20.

The controller 18 is nestably positioned between the laterally projecting portion 28 of the housing assembly 12 and the housing cover 20 in a highly space efficient manner, and with the first portion 112 of the circuit board 110 generally axially aligned with the stator 78. As such, only very short lengths of electrical conductors are needed to electrically couple the electric motor 16 to the controller 18. It will be appreciated that terminals 180 associated with the controller 18 and a surrounding portion 182 of the housing cover 20 cooperate to form one or more connectors 184 that is/are adapted to be mated to one or more mating connectors (not shown) on a wire harness (not shown) to permit data and power to be transmitted to the controller 18.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A G-rotor pump assembly comprising:

a unitarily and integrally formed housing having a pump/motor housing portion defining a stator cavity, a pump cavity, a first bearing cavity, and a first portion of a fluid outlet, the stator cavity, the pump cavity and the first bearing cavity being disposed along a longitudinal axis of the pump/motor housing portion such that the first bearing cavity is disposed along the longitudinal axis between the stator cavity and the pump cavity, and a laterally projecting housing portion extending laterally of the longitudinal axis;

an electric motor having a stator, which is received in the stator cavity, an armature, which is rotatably disposed in the stator and a motor shaft that is coupled to the armature for rotation therewith, the motor shaft extending along the longitudinal axis of the pump/motor housing portion through the stator cavity and the first bearing cavity;

a G-rotor pump having inner and outer rotors that are received in the pump cavity, the inner rotor being fixedly mounted to the motor shaft for rotation therewith;

a first cap mounted to the housing to close the pump cavity, the first cap defining a fluid intake and a second portion of the fluid outlet of the G-rotor pump assembly, the fluid inlet being coupled in fluid communication with the cavity, the second portion of the fluid outlet being coupled in fluid communication with the first portion of the fluid outlet, wherein a portion of the motor shaft extends into the fluid intake and is cantilevered;

a first bearing received in the first bearing cavity and mounted to the motor shaft and the pump/motor housing portion;

a motor support member fixedly coupled to the stator, the motor support member defining a second bearing cavity;

a second bearing received in the second bearing cavity and mounted to the motor shaft and the motor support member;

a controller having a circuit board with a first circuit board portion which is positioned within the pump/motor housing portion in a plane that intersects the longitudinal axis of the electric motor, and a second circuit board portion extending laterally of the first portion and positioned within the laterally projecting housing portion, the first circuit board portion having an opening therein aligned with the motor shaft; and the first portion of the circuit board residing between the stator and the motor support member and being fixedly coupled to the stator, the motor shaft passing axially through the opening in the first circuit board portion;

wherein the motor shaft is supported radially along its entire length by the first and second bearings.

2. The G-rotor pump assembly of claim 1, further comprising a seal received in the pump/motor housing portion disposed along the longitudinal axis between the pump cavity and the stator cavity.

3. The G-rotor pump assembly of claim 2, wherein the pump/motor housing portion defines a seal cavity disposed along the longitudinal axis between the first bearing cavity and the stator cavity, and wherein the seal is received in the seal cavity and sealingly engages the pump/motor housing portion and the motor shaft.

4. The G-rotor pump assembly of claim 3, wherein the first cap defines a fluid path that vents fluid discharged from the G-rotor pump into the first bearing cavity.

5. The G-rotor pump assembly of claim 3, wherein the fluid path is disposed in fluid communication with the seal cavity.

6. The G-rotor pump assembly of claim 1, further comprising a filter screen received in the pump intake.

7. The G-rotor pump assembly of claim 1, wherein the pump intake extends through the first cap in an axial direction along the longitudinal axis.

8. The G-rotor pump assembly of claim 1, further comprising first and second surface seals, the first surface seal being disposed about the pump/motor housing portion along the longitudinal axis between the first portion of the fluid outlet and a mounting flange, the second seal being disposed about the first cap along the longitudinal axis on a side of the second portion of the fluid outlet that is opposite the first portion of the fluid outlet.

* * * * *